United States Patent [19]

Carrier et al.

[11] Patent Number: 4,768,924

[45] Date of Patent: Sep. 6, 1988

[54] CERAMIC STATOR VANE ASSEMBLY

[75] Inventors: Gilles Carrier, Ville Lemoyne; Michael D. Stoten, Oakville; Patrick Szwedska, Mississauga, all of Canada

[73] Assignee: Pratt & Whitney Canada Inc., Longueuil, Canada

[21] Appl. No.: 887,930

[22] Filed: Jul. 22, 1986

[51] Int. Cl.[4] ..... F01D 9/04

[52] U.S. Cl. ..... 415/189; 415/214; 415/138

[58] Field of Search ..... 415/134, 136–139, 415/185, 189, 190, 197, 200, 214, 217, 218; 416/241 B

[56] References Cited

U.S. PATENT DOCUMENTS

| | | | |
|---|---|---|---|
| 3,843,279 | 10/1974 | Crossley et al. | 415/214 X |
| 3,854,843 | 12/1974 | Penny | 416/241 B X |
| 3,857,649 | 12/1974 | Schaller et al. | 415/200 |
| 3,910,716 | 10/1975 | Roughgarden et al. | 415/214 X |
| 3,966,353 | 6/1976 | Booher, Jr. et al. | 415/115 |
| 4,076,451 | 2/1978 | Jankot | 415/217 |
| 4,518,315 | 5/1985 | Kruger | 416/241 B |
| 4,643,636 | 2/1987 | Libertini et al. | 415/214 X |

FOREIGN PATENT DOCUMENTS

| | | | |
|---|---|---|---|
| 2062119 | 5/1981 | United Kingdom | 415/200 |

*Primary Examiner*—Robert E. Garrett
*Assistant Examiner*—Joseph M. Pitko

[57] ABSTRACT

A ceramic stator vane assembly for a gas turbine engine comprises a plurality of ceramic stator vane segments arranged in an annular array with each vane segment having integral concentric tip and root platform members. The tip and root platform members define continuous inner and outer surfaces for receiving inner and outer ceramic rings. Radial and axial housing members are provided for mounting the stator vane assembly within the engine, and thermal insulation means are provided between the ceramic vane assembly and the housing members.

7 Claims, 2 Drawing Sheets

FIG. 1
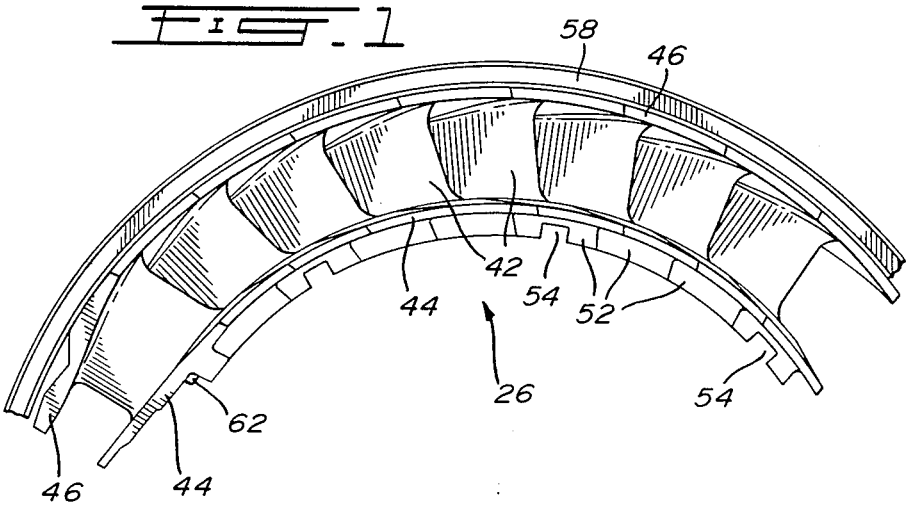
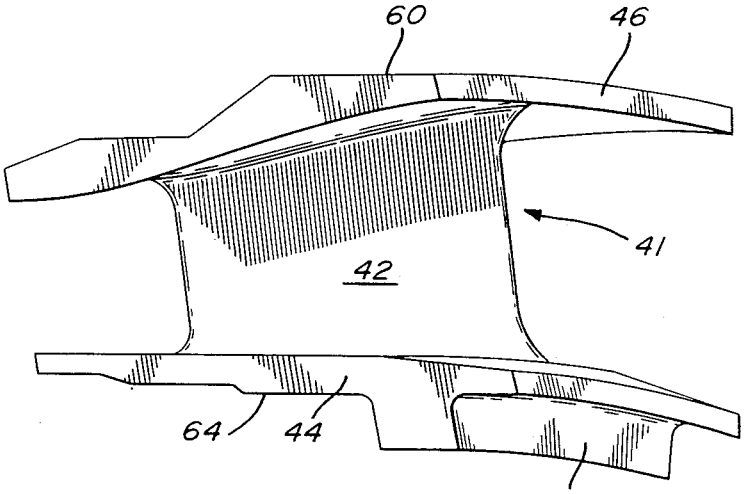
FIG. 2

CERAMIC STATOR VANE ASSEMBLY

BACKGROUND OF THE INVENTION

1. Field of the Invention

The present invention relates to turbine engines, and more particularly to ceramic stator vane assemblies.

2. Description of the Prior Art

The problem is well known. Ceramic stator vanes would make excellent stator vanes in the turbine section of the engine. High strength ceramics have a much higher melting temperature than most known metal alloys. Metal alloy stator vanes require sophisticated cooling systems which usually means providing intricate cooling passages in the airfoils of the stator vanes. These cooling systems are often impractical when dealing with small scale turbine engines having vane airfoils with a height of approximately 1 inch. Further, if cooling systems are provided, the vanes must be enlarged in order to provide the cooling passages, thus compromising the aerodynamic performance of the airfoil. Finally, such vanes are very expensive to fabricate.

Ceramic stator vanes, on the other hand, do not require the cooling passages of an alloy vane and thus can be made lighter and more aerodynamically efficient. However, these known ceramics cannot be subjected to very high tensile stresses. On the other hand, ceramic material can be subjected to high compressive stresses before deteriorating. Attempts have been made, therefore, to mount ceramic vanes under compression. Such attempts are illustrated, for instance, in U.S. Pat. No. 4,076,451, issued Feb. 28, 1978 to Alan L. Jankot. In this patent, the compressive forces on the ceramic vane assembly are provided by a continuous metal shroud or ring and the inherent expansion of the metal ring. In an environment contemplated, the temperature in the gas path would be well in the 2500° F. average. Such temperatures would be rapidly transmitted to the extremities of the vanes, and thus the metal rings surrounding the vanes would melt unless they were subjected to a cooling flow, which would again defeat the initial purpose of using the ceramic vanes. Cooling systems, of course, use air within the engine which has been compressed, and thus, if such compressed air is used for cooling, it has the same effect as leakage, which is an energy loss, thus reducing the efficiency of the engine. If the thermal conductivity of the ceramic material is high, the cooling of the peripheral extremities thereof would create serious thermal stresses within the ceramic vanes.

U.S. Pat. 3,966,353, issued June 29, 1976 to Claude R. Booher, Jr. et al, describes a ceramic vane ring assembly utilizing a multi-component system with insulating pads and spring devices or other for maintaining the vanes under compression. As evident from the Booher, Jr. et al patent, much leakage would occur surrounding the vane assembly. The same can be said for U.S. Pat. 3,857,649, issued Dec. 31, 1974 to Richard J. Schaller et al.

SUMMARY OF THE INVENTION

It is an aim of the present invention to provide a ceramic stator vane assembly which overcomes the problems noted above. More specifically, it is an aim of the present invention to provide a high strength ceramic vane assembly wherein the vanes are maintained under compression while minimizing the leakage, thereby reducing costs and increasing the efficiency of the turbine section.

In other words, the present invention aims to capture all of the known advantages of using ceramic stator vanes in the turbine section of a gas turbine engine while solving the problems normally associated with such assemblies.

A construction in accordance with the present invention comprises a ceramic vane assembly for a gas turbine engine, the vane assembly comprising a plurality of ceramic stator vane segments arranged in an annular array with each vane having integral, concentric, tip and root platforms. The tip and root platforms define continuous inner and outer races. An outer ceramic ring surrounds the vane assembly about the outer surface with an interference fit and is subject to tensile stress during thermal expansion. An inner ceramic ring is provided with an interference fit within the inner surface and is subject to compression stress under thermal expansion. Radial and axial housing means are provided for mounting said stator vane assembly within said engine, and thermal insulation means are provided between said ceramic vane assembly and said housing means.

Thus, the ceramic vane assembly of the present invention is a prestressed assembly where ceramic vane segments are kept under compressive stresses between two ceramic rings. Since the shrouds of the individual vanes are full and abut each other, the vane assembly simulates a monolithic vane ring and, therefore, greatly reduces leakage which can take place between vane segments. By keeping the airfoil of the vane under compressive stress, the chance of cracks propagating through the vane is reduced. The tight interference of the rings with the vanes in the assembly induces tensile stresses in the outer ring and compressive stresses in the inner ring. The cross-section of the inner ring must be kept as small as possible to minimize potential dangerous tensile stresses in the outer ring. The outer ring, on the other hand, must be proportionally much larger and of simple geometric shape in order to absorb the tensile stresses which occur in the assembly.

The prestressing of the vane assembly is done by cold interference fit.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a front elevation of a segment of a turbine assembly in accordance with the present invention;

FIG. 2 is a front elevation of a single vane from the vane assembly shown in FIG. 1.

DESCRIPTION OF THE PREFERRED EMBODIMENTS

Figure 3:
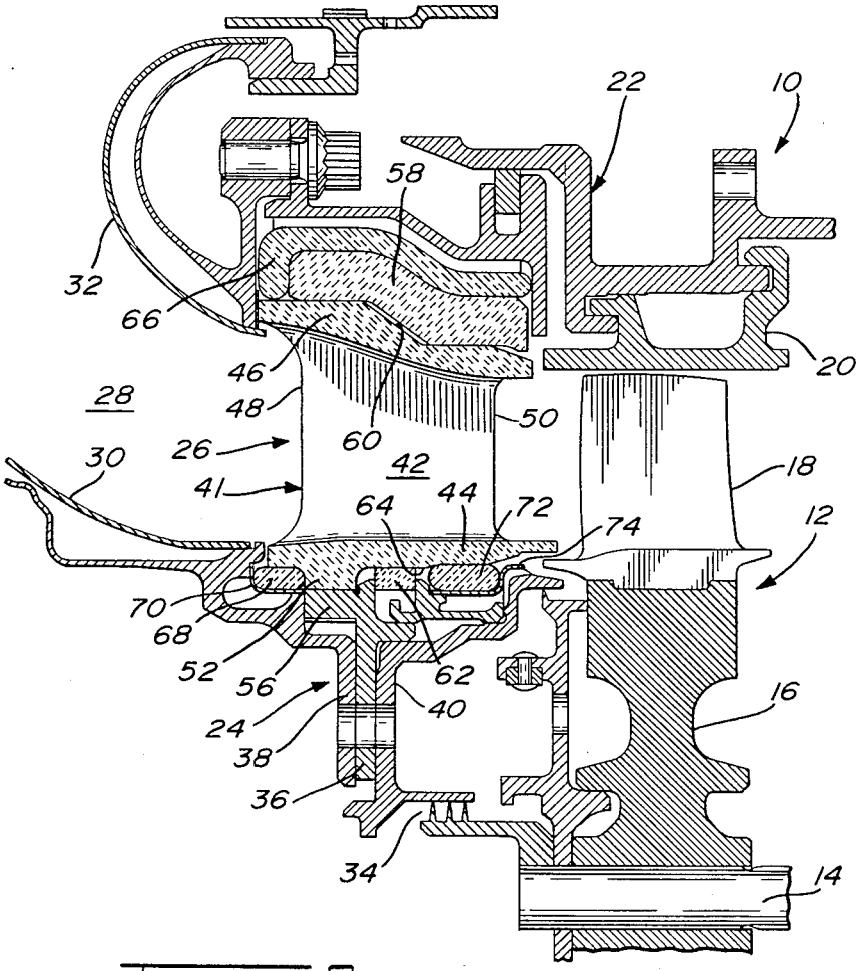
FIG. 3 is an axial cross-section taken through the turbine section of the gas turbine engine incorporating the present invention.

Referring now to the drawings, the entry of a typical turbine section 10 of a gas turbine engine is shown in FIG. 3. A rotor assembly 12 is mounted on a shaft 14. The rotor assembly includes a rotor hub 16 and radially extending rotor blades 18. A stationary shroud 20 surrounds the rotor assembly 12. The shroud 20 is mounted within the housing 22.

Upstream of the rotor assembly 12 is the stator section including stator support structure 24 and a stator assembly 26. The gas path 28 is defined at the exhaust of the combustion chamber outlet 32 and is in the form of an annulus extending axially from the combustion chamber outlet 32. The hub wall 30 defines the inner limits of the gas path 28.

The stator support includes, as shown in FIG. 3, support elements 36, 38, and 40, which are normally bolted together and include a labyrinth seal 34 between the rotor assembly 12 and the stator support 24.

The stator assembly 26 is made up of individual identical vane segments 41 each having an airfoil 42, a root platform 44, and a tip platform 46. The vane segments 41 are best illustrated in FIG. 2, while the stator assembly 26 is best illustrated in FIG. 1.

Each of the vane segments 41 is molded of ceramic material of the type known as high strength engineering ceramic, such as silicon carbide or silicon nitride. In an experiment, the actual vane segments 41 were made of alpha silicon carbide.

Each of the airfoils 42 defines a leading edge 48 and a trailing edge 50. The root platform 44 is provided with a radial root member 52 interspersed by slots 54 as seen in FIG. 1. The stator assembly 26 is completed by an outer circumferential continuous ring 58 made of a ceramic material and of a size shown proportionally in FIG. 3. The outer ring 58 sits on the outer surface 60 of the tip platform 46. An inner ring of much smaller dimensions extends peripherally about the root platform 44 downstream of the root member 52, as shown in FIG. 3. The inner ring 62 sits on the inner surface 64. The outer ring 58 and inner ring 62 are also made of high strength ceramic material. Preferably, and as utilized in experiments mentioned above, the rings 58 and 62 were made of reaction sintered silicon carbide because of its slightly higher fracture toughness. The vane segments 41 were made of alpha silicon carbide because of its good oxidation resistance at high temperature. It is possible, however, to make the rings of alpha silicon carbide without sacrificing strength.

The prestressing of the stator vane assembly 26 is done by a cold interference fit. The criterion of the interference is governed by the worst deceleration phase of the engine. At this phase, the vane segments 41 will cool quite rapidly while the rings 58 and 62 are still hot. Being colder, the vanes 41 will shrink more rapidly than the rings 58 and 62. This shrinkage difference must be smaller than the initial cold interference; otherwise, these segments 41 would get loose between the rings 58 and 62.

The outer ring 58 is kept under tensile stress especially during transient conditions. It has been found that a 0.0045" cold interference would be sufficient to ensure a positive fit even at the worst possible deceleration. It is obvious that this interference must be kept as small as possible to minimize the induced stress. Since all ceramic materials are known not to have high tensile strength, the outer ring 58 is proportionally much larger than the inner ring 62 which is under compression. It has been found in tests that the maximum stress applied to the outer ring 58 was 14.1 KSI. At a steady operation, the maximum tensile strength goes down to 9.4 KSI, while at deceleration, the maximum stress was 11.6 KSI.

The inner ring 62 is subjected to a compressive stress. In the tests, the highest compressive stress observed in the ring 62 was −109 KSI. At deceleration, the inner ring 62 is unloaded and the compressive stress dropped to only a few KSI before returning to its original operating level. The analysis presented in the above-mentioned experiments was done with an initial cold interference of 0.0046". A higher initial interference will produce a higher induced stress in both rings. With the configuration as shown, the maximum stress on the outer ring will be raised by 0.9 KSI for each additional one thousandth of an inch of interference.

It is somewhat difficult to predict the consistency of the strength of the various ceramic parts. For instance, if one breaks a number of the ceramic specimens by bend tests, a large scatter can be observed in the rupture stress results. Statistical methods must be used to characterize the strength of the material. It is known, however, that the strength of the material is somewhat directly dependent of its size. In other words, small parts are stronger than larger ones. Thus, one of the reasons for providing independent vane segments 41 as opposed to a monolithic stator vane assembly.

Because of the absence of reliable analytic methods to evaluate the strength of these ceramic parts, the parts are proof tested. This proof testing consists of loading the parts at a higher stress level than the operating stress in order to eliminate weaker specimens prior to their utilization. Because of their brittleness, the parts are not damaged by proof testing, and surviving parts are as good as new parts.

As previously mentioned, the ceramic parts conduct heat and, therefore, must be insulated from the supporting metal structures to avoid thermal stresses and to prevent the melting of the metal parts since the temperature of the vane segments 41 in the gas path 28 can easily rise to 100° or 200° F. above the melting point of the metal parts. Thus, an insulation member 66 surrounds the outer ring 58, while insulating rings 68 and 72 are provided under the root platforms 44. The thermal insulation 66, 68, and 72, as mentioned, helps to reduce thermal stresses in the ceramic parts. The temperature of the air outside the gas path 28, that is, on the metal parts supporting the vane ring assembly 26, is considerably lower than the temperature in the gas path 28. Thus, without insulation, the thermal gradients from the peripheries of the stator vane assembly 26 to the center thereof would be quite high. In order to reduce this thermal gradient, the insulation is utilized, thus lowering the thermal stresses within the ceramic parts. The insulating material 66, 68, and 72, can be made of ceramic fibers commercially available such as the trade mark "Kaowool" sold by Babcock & Wilcox. The fibers are held in a thin metallic envelope. Brackets 70 and 74 are provided for holding the insulation members 68 and 72 against the root platform 44.

It is necessary, however, to have some metal contact with the ceramic parts. Referring to FIG. 3, the support member 36 contacts the root member 52 and likewise the projection 56 from the support member 36 engages within the slot 54 defined in the root members. This prevents both circumferential and axial movement of the stator vane assembly 26 relative to the support structure. On the other hand, these metal to ceramic contact points must be protected. Wherever there is a possibility of contact between the ceramic parts and the metal parts, a coating such as zirconia in the form of a plasma spray is provided on such surfaces. One form may be a powder composite made of zirconium oxide and yttrium oxide.

We claim:

1. A ceramic vane assembly for a gas turbine engine, the vane assembly comprising a plurality of ceramic stator vane segments arranged in an annular array simulating a monolithic stator vane ring with each vane segment having integral concentric tip and root platform members, said tip and root platform members defining continuous inner and outer shroud surfaces, and outer ceramic ring surrounding the vane assembly on the outer shroud surface in a cold interference fit and subject to tensile stresses during all thermal conditions, an inner ceramic ring provided in a cold interference fit within the inner shroud surface and subject to compression stress during all thermal conditions, the vane assembly being compressively prestressed by the inner and outer ceramic rings, radial and axial housing means provided for mounting said prestressed stator vane assembly within said engine, and thermal insulation means provided between the mounting means and said prestressed ceramic vane assembly and the inner and outer ceramic rings.

2. A ceramic vane assembly as defined in claim 1, wherein the ceramic material is silicon carbide.

3. A vane assembly as defined in claim 2, wherein the stator vane segments are silicon carbide while the outer and inner rings are silicon carbide.

4. A ceramic vane assembly as defined in claim 1, wherein the ceramic material is silicon nitride.

5. A vane assembly as defined in claim 4, wherein the stator vane segments are silicon nitride while the outer and inner rings are silicon nitride.

6. A ceramic vane assembly as defined in claim 1, wherein the outer ring which is under tensile stress during thermal expansion is substantially larger in cross-section than the inner ring which is under compression stress during thermal expansion.

7. A stator vane assembly as defined in claim 1, wherein the insulation material is in the form of ceramic fibers held within a thin metallic envelope.

* * * * *